US010349471B2

(12) United States Patent
Oishibashi

(10) Patent No.: US 10,349,471 B2
(45) Date of Patent: Jul. 9, 2019

(54) MICROWAVE HEATING APPARATUS

(71) Applicant: Hiroji Oishibashi, Fukui (JP)

(72) Inventor: Hiroji Oishibashi, Fukui (JP)

( * ) Notice: Subject to any disclaimer, the term of this patent is extended or adjusted under 35 U.S.C. 154(b) by 0 days.

(21) Appl. No.: 15/572,079

(22) PCT Filed: Jul. 13, 2017

(86) PCT No.: PCT/JP2017/025551

§ 371 (c)(1),
(2) Date: Nov. 6, 2017

(87) PCT Pub. No.: WO2018/123117

PCT Pub. Date: Jul. 5, 2018

(65) Prior Publication Data

US 2018/0352616 A1 Dec. 6, 2018

(30) Foreign Application Priority Data

Dec. 26, 2016 (JP) ..... 2016-251421

(51) Int. Cl.
*H05B 6/70* (2006.01)
*D01F 9/32* (2006.01)
(Continued)

(52) U.S. Cl.
CPC ..... *H05B 6/708* (2013.01); *D01F 9/32* (2013.01); *H05B 6/78* (2013.01); *H05B 6/788* (2013.01); *H05B 6/80* (2013.01)

(58) Field of Classification Search
CPC ..... H05B 6/708; H05B 6/78; H05B 6/80
(Continued)

(56) References Cited

U.S. PATENT DOCUMENTS

2009/0277772 A1 11/2009 Kaiser et al.
2010/0012147 A1* 1/2010 Lu ..... A61L 2/10 134/1
(Continued)

FOREIGN PATENT DOCUMENTS

JP 47-24186 7/1972
JP 63-51641 4/1988
(Continued)

OTHER PUBLICATIONS

Written Opinion of the International Searching Authority dated Sep. 12, 2017 in International (PCT) Application No. PCT/JP2017/025551.
(Continued)

*Primary Examiner* — Dana Ross
*Assistant Examiner* — Joseph M Baillargeon
(74) *Attorney, Agent, or Firm* — Wenderoth, Lind & Ponack, L.L.P.

(57) ABSTRACT

Microwave irradiator 12 is attached to a furnace main body of a heating furnace 11 having microwave permeability. A running passage for passing a fiber member F which is the object to be heated is formed inside the heating furnace 11. A first tubular member 13 made of a first microwave heat-generating material absorbing microwave energy and generating heat is rotatably disposed around the running passage. A second tubular member made of a second microwave heat-generating material absorbing microwave energy and generating heat is disposed in the first tubular member 13. The fiber member F is heated and calcined while running the fiber member F containing carbon in the running passage of the second tubular member 14.

10 Claims, 4 Drawing Sheets

(51) Int. Cl.
*H05B 6/78* (2006.01)
*H05B 6/80* (2006.01)

(58) Field of Classification Search
USPC ..... 219/693, 679, 680, 710, 712, 756, 762; 373/136; 374/149
See application file for complete search history.

(56) References Cited

U.S. PATENT DOCUMENTS

| | | | | |
|---|---|---|---|---|
| 2010/0183476 | A1 | 7/2010 | Lu | |
| 2011/0139773 | A1* | 6/2011 | Fagrell | H05B 6/46 219/702 |
| 2013/0098904 | A1* | 4/2013 | Harada | D01F 9/32 219/756 |

FOREIGN PATENT DOCUMENTS

| | | |
|---|---|---|
| JP | 2588012 | 3/1997 |
| JP | 2001-296010 | 10/2001 |
| JP | 2002-13031 | 1/2002 |
| JP | 2009-515652 | 4/2009 |
| JP | 2009-533562 | 9/2009 |
| JP | 2013-2767 | 1/2013 |
| JP | 2013-231244 | 11/2013 |
| JP | 5877448 | 3/2016 |
| KR | 10-2013-0110237 | 10/2013 |

OTHER PUBLICATIONS

International Search Report dated Sep. 12, 2017 in International (PCT) Application No. PCT/JP2017/025551.

Japanese Decision to Grant a Patent dated May 1, 2017 in corresponding Japanese Patent Application No. 2016-251421 with English translation.

* cited by examiner

MICROWAVE HEATING APPARATUS

TECHNICAL FIELD

The present invention relates to a microwave heating apparatus suitable for an increase in strength and an increase in elasticity of a fiber member.

BACKGROUND ART

Conventionally, it is known that various organic or inorganic fiber members are heated and calcined by microwaves to achieve high strength and high elasticity of the fiber members. For example, Patent Literature 1 (JP S47-24186 B1) and Patent Literature 2 (JP 5877448 B1) disclose a method in which organic synthetic fibers are carbonized by microwave heating and further graphitized.

CITATION LIST

Patent Literature

Patent Literature 1: JP S47-24186 B1
Patent Literature 2: JP 5877448 B1

SUMMARY OF THE INVENTION

Technical Problems

In order to calcine an organic fiber to carbonize it, a calcining temperature of 1,000° C. to 2,000° C., inclusive, is necessary. Further, in order to calcine a carbon fiber to graphitize it, a calcining temperature of 2,500° C. or higher, preferably about 2,800° C. is necessary. However, in a conventional microwave heating apparatus, temperature unevenness tends to occur in the furnace and soaking heating of heating the fibers uniformly has been difficult. In a graphitizing apparatus, it has been difficult to increase the temperature to 2,500° C. or higher. For this reason, the carbon fiber obtained in a carbonization furnace is partially broken and has a limit on the increase in strength. On the other hand, a graphite fiber obtained in a graphitizing furnace has a limit on the increase in elasticity because the overlapping of the graphite crystal structure in a fiber direction is insufficient.

It is an object of the present invention to provide a microwave heating apparatus in which an increase in the calcining temperature is easy and thermal uniformity is improved.

Solution to Problems

In order to achieve the above object, a microwave heating apparatus of the present invention includes:

a heating furnace in which a microwave irradiator is attached to a furnace main body having microwave permeability;

a running passage formed inside the heating furnace for passing a fiber member which is the object to be heated;

a first tubular member which is made of a first microwave heat-generating material absorbing microwave energy and generating heat in the heating furnace and is rotatably disposed around the running passage; and a second tubular member which is made of a second microwave heat-generating material absorbing microwave energy and generating heat in the first tubular member and has the running passage formed at its center portion, wherein the fiber member is heated and calcined while running the fiber member in the running passage of the second tubular member.

Advantageous Effects of Invention

In the microwave heating apparatus of the present invention, since the first tubular member made of the first microwave heat-generating material generating heat by microwave energy is rotatably disposed around the running passage of the fiber member which is the object to be heated, soaking heating by radiant heat from the rotating first tubular member can be performed in the periphery of the fiber member. Therefore, it is possible to prevent filament breakage and fuzz of the fiber member, and to raise an upper limit of high strength and high elasticity of the fiber member.

DESCRIPTION OF EMBODIMENTS

Figure 1:
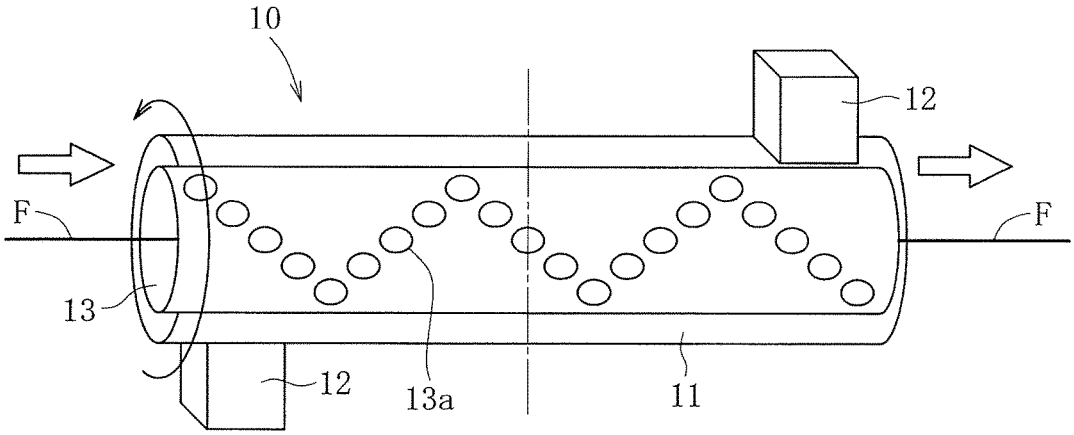
FIG. 1 is a schematic overall sectional view of a microwave heating apparatus according to an embodiment of the present invention.

As shown in FIG. 1, the microwave heating apparatus 10 according to the embodiment of the present invention includes a horizontally long tubular heating furnace 11. A microwave irradiator 12 is disposed near both end portions of a furnace main body of the heating furnace 11. One microwave irradiator 12 is arranged on a lower side of the furnace main body and the other microwave irradiator 12 is arranged on an upper side of the furnace main body. That is, a pair of right and left microwave irradiators 12 is disposed symmetrically with respect to the longitudinal center of the heating furnace 11.

The furnace main body of the heating furnace 11 has microwave permeability and is made of, for example, ceramic, zirconia, alumina, quartz, sapphire, or a combined heat-resistant material of these materials. A metal plate constituting the outer wall is wound around the outer periphery of the furnace main body.

Inside the heating furnace 11, a linear running passage extending in the longitudinal direction of the heating furnace 11 is formed so that a fiber member F of a single fiber can pass through. Inside the heating furnace 11, a first tubular member 13 is disposed so as to surround the running passage.

The first tubular member 13 is made of a first microwave heat-generating material that absorbs microwave energy and generates heat, and a large number of through holes 13*a* are formed in a radial direction of the first tubular member 13. These through holes 13*a* are for allowing the microwaves from the microwave irradiator 12 to directly reach an internal second tubular member 14 and further to the fiber member F on the inner side of the second tubular member 14. Therefore, a fiber thread F as the fiber member F can be directly irradiated with microwave energy and radiant heat generated by microwave heating from the first tubular member 13 can be applied to the fiber thread F. High temperature heating and soaking heating of the fiber member F can be achieved by a combination of the direct heating by the direct irradiation of the microwave and the radiant heating by the radiant heat.

The first microwave heat-generating material of the first tubular member 13 is made of, for example, a graphite material, a silicon carbide material, a silicidation metal (silicidation molybdenum, silicidation tungsten, etc.), a silicidation ion compound, a silicidation graphite material, silicidation nitride, a silicidation carbon fiber composite material, a magnetic compound, a nitride, or a combined heat-resistant material of these materials. The first tubular member 13 is disposed coaxially with the heating furnace 11, that is, the axis thereof is made to coincide with the linear running passage, and is configured to be able to continuously rotate in one direction around the axis.

A pair of bearings is disposed at both end sides in a longitudinal direction of the heating furnace 11, and the first tubular member 13 is rotatably supported by the pair of bearings. A rotation driving apparatus such as a motor for rotating the first tubular member 13 is disposed near one bearing.

(Second Tubular Member)

Inside the first tubular member 13, a second tubular member is disposed as described below. A plurality of embodiments of the second tubular member are possible, and the first to third embodiments will be described below.

First Embodiment

Figure 2A:
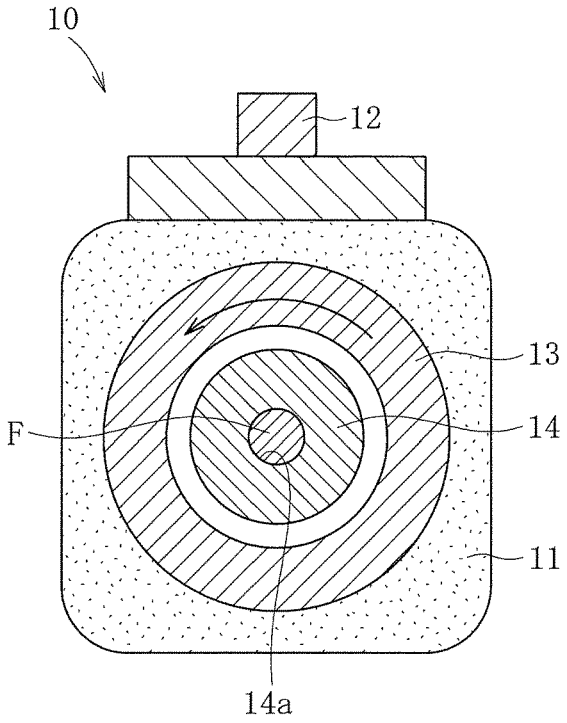
FIG. 2A is a transverse sectional view of a microwave heating apparatus according to a first embodiment of the present invention.
Figure 2B:
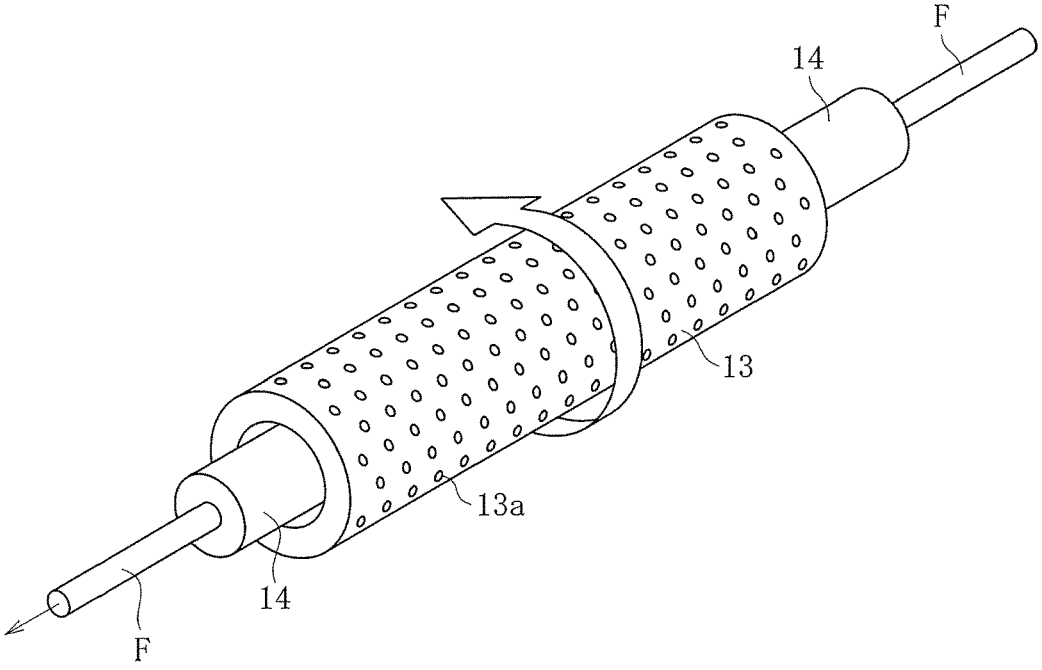
FIG. 2B is a perspective view of a first tubular member and a second tubular member of the microwave heating apparatus according to the first embodiment of the present invention.

As shown in FIG. 2A and FIG. 2B, the second tubular member 14 of the first embodiment is arranged concentrically inside the first tubular member 13. The second tubular member 14 is made of, for example, a graphite material or a silicon carbide material, which is a material having a property of absorbing a part of microwaves and generating heat.

Both the graphite material and the silicon carbide material absorb microwaves and generate heat, but the microwave absorption rate is relatively better for the graphite material (48.7%) than for the silicon carbide material (42.9%). On the other hand, the silicon carbide material is indispensable for suppressing a discharge phenomenon of the fiber member F by microwaves, but if it is too much, various problems will arise as described later.

The second tubular member 14 may be made of a mixed material of the silicon carbide material and the graphite material, and a mixing ratio in this case is, for example, 5% to 70% with the silicon carbide material, and 30% to 95% with the graphite material. With respect to the optimum mixing ratio for elevating the furnace temperature in the heating furnace 11, the silicon carbide material is 15% and the graphite material is 85%.

As described above, the silicon carbide material is indispensable for suppressing the discharge phenomenon in graphitizing the fiber member F. However, when the silicon carbide material exceeds a predetermined proportion, the possibility of filament breakage and fuzz occurrence of the fiber member F is increased. If the amount of the silicon carbide material is larger than the predetermined ratio, the silicon material component exudes and accumulates on the inner surface of the central hole 14*a* through which the fiber member F passes, and the fiber member F becomes increasingly likely to be damaged by being rubbed by the accumulated silicon material component. In addition, a temperature of the center portion of the fiber member F hardly rises, making it difficult to elevate the temperature.

Therefore, in the embodiment of the present invention, it is preferred that the proportion of the silicon carbide material is in the range of at most 10% to 30%, desirably 12% to 24%, and more desirably 15% to 18%. The rest of the mixed material is all the graphite material. Thereby, the balance between the surface heating and the central heating of the fiber member F is improved, and a carbonized fiber or a graphitized fiber free from filament breakage or fuzz occurrence is obtained.

The second tubular member 14 is configured to allow the fiber member F containing carbon, for example, one single fiber thread F of an organic fiber or a single fiber thread F of a carbon fiber to run and pass through a central hole 14*a* of the second tubular member 14 at a predetermined speed with a predetermined tension applied. The predetermined tension is necessary for growing carbon crystals in the longitudinal direction of the fiber member F and filling fine voids within the fiber to increase the strength and elasticity of the fiber. The inside of the central hole 14*a* is filled with an inert gas such as nitrogen gas or brought into vacuum to prevent oxidation of the fiber member F. Both end portions in the longitudinal direction of the second tubular member 14 are supported by supporting members arranged on the outer sides of both end portions of the first tubular member 13.

Then, the single fiber thread F is heated and calcined while running and passing the single fiber thread F of an organic fiber or carbon fiber with a predetermined tension applied inside the second tubular member 14. The single fiber thread F may be any one of an organic single fiber thread F and an inorganic single fiber thread F. The organic single fiber thread F can be made of, for example, bamboo, lumber, plants, chemicals, chemical fibers, or the like. The inorganic single fiber thread F can be made of, for example, a ceramic material, a carbon material, other inorganic products, inorganic fibers, or the like. When a ceramic fiber as a ceramic material, for example, is heated by microwave using the apparatus of the present embodiment, column crystals of silicon nitride can be satisfactorily developed in the fiber and high toughness of the fiber can be achieved.

Second Embodiment

Figure 3A:
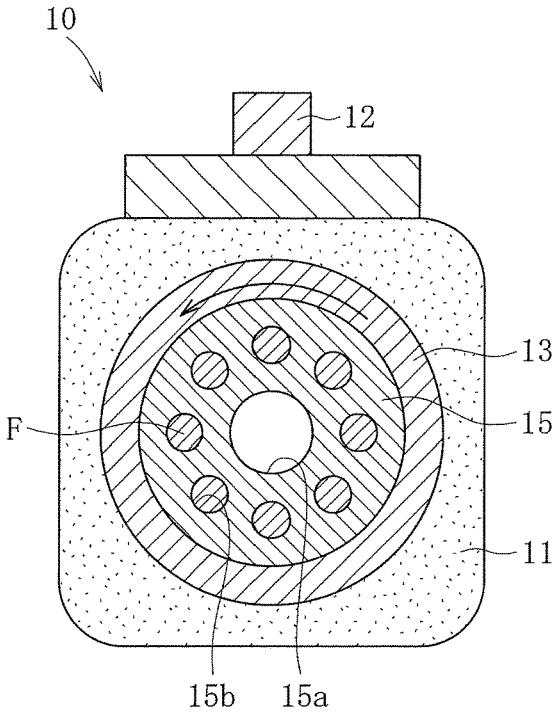
FIG. 3A is a transverse sectional view of a microwave heating apparatus according to a second embodiment of the present invention.
Figure 3B:
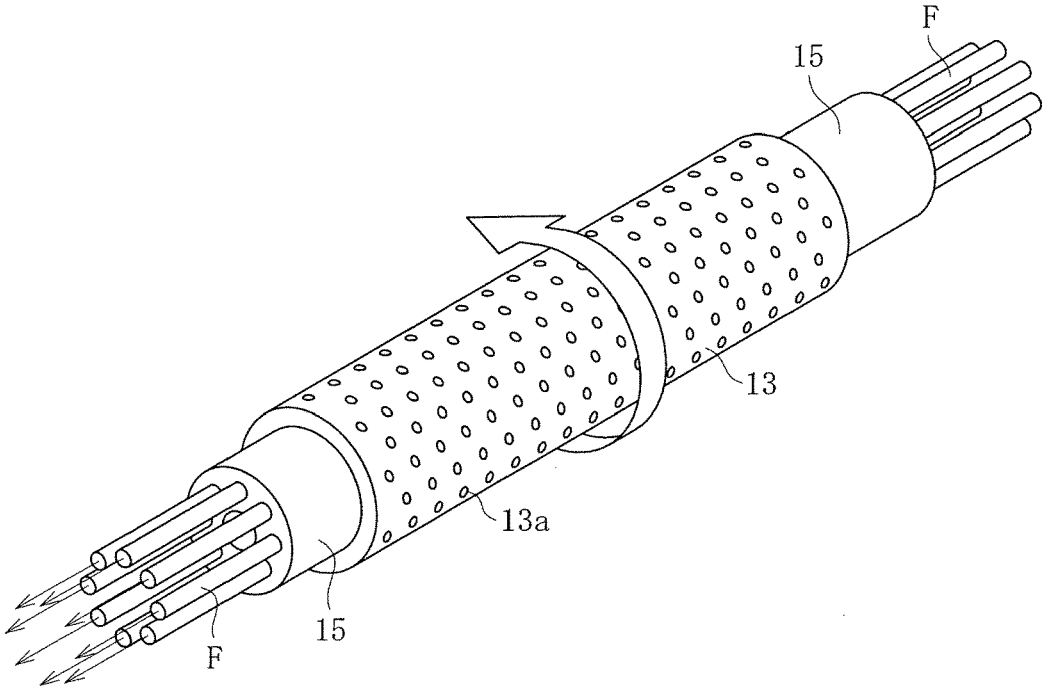
FIG. 3B is a perspective view of a first tubular member and a second tubular member of the microwave heating apparatus according to the second embodiment of the present invention.

As shown in FIG. 3A and FIG. 3B, a second tubular member 15 of the second embodiment is arranged concentrically inside the first tubular member 13. The second tubular member 15 is made of a graphite material or a silicon carbide material, and eight circular small holes 15*b* are formed at equal intervals in a circumferential direction around a central large circular hole 15*a*. As with the first embodiment, the mixing ratio in the case where the second tubular member 14 is made of a mixed material of the silicon carbide material and the graphite material is, for example, 5% to 70% with the silicon carbide material, and 30% to 95% with the graphite material. With respect to the optimum mixing ratio for elevating the furnace temperature in the heating furnace 11, the silicon carbide material is 15% and the graphite material is 85%.

It is preferred that the proportion of the silicon carbide material is in the range of at most 10% to 30%, desirably 12% to 24%, and more desirably 15% to 18% as with the first embodiment. The rest of the mixed material is all the graphite material. Thereby, the balance between the surface heating and the central heating of the fiber member F is improved, and a carbonized fiber or a graphitized fiber free from filament breakage or fuzz occurrence is obtained.

The second tubular member 15 is configured to allow the fiber member F containing carbon, for example, one carbon fiber thread F to run and pass through the small holes 15*b* at a predetermined speed with a predetermined tension applied. By doing so, the production efficiency of the calcined fiber member F can be improved more than in the first embodiment. Both end portions in the longitudinal direction of the second tubular member 15 are supported by supporting members arranged on the outer sides of both end portions of the first tubular member 13 as with the first embodiment.

Third Embodiment

Figure 4:
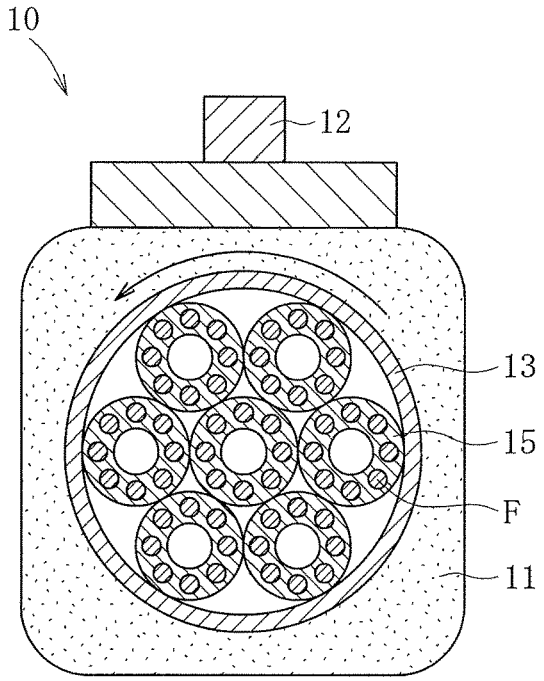
FIG. 4 is a transverse sectional view of a microwave heating apparatus according to a third embodiment of the present invention.

In the third embodiment, as shown in FIG. 4, a plurality (seven) of the second tubular members 15 of the second embodiment are disposed inside the first tubular member 13. That is, six second tubular members 15 are arranged around the second tubular member 15 at the center without clearance. By doing so, the production efficiency of the calcined fiber member F is dramatically improved.

The microwave heating apparatus 10 is configured as described above, and the operation of the microwave heating apparatus 10 is as follows. When microwaves are irradiated from the upper and lower microwave irradiators 12, the microwaves permeate through the furnace main body of the heating furnace 11 and heat the first tubular member 13. Thereby, a temperature of the first tubular member 13 is elevated, and the inner second tubular member 14 (15) is heated by radiant heat from the first tubular member 13.

On the other hand, the microwaves from the microwave irradiators 12 not only heat the first tubular member 13 but also reach the second tubular member 14 (15) through the holes or slits of the first tubular member 13. The microwave further permeate through the graphite of the second tubular member 14 (15) and directly irradiate the fiber member F on the inner side of the second tubular member 14 (15). Thereby, the calcining temperature of the fiber member F reaches at least 1,000° C. to 2,500° C., inclusive, and when the fiber member F is a carbon fiber, graphitization of the fiber or formation of graphitized fiber is promoted in a high temperature region exceeding 2,500° C.

At this time, since the first tubular member 13 is rotating, no heat spot is generated in the first tubular member 13 and the graphitized fiber F, and graphitization is uniformly promoted on the surface and the inside of the fiber F. As a result, there is no gap in the overlapping of the graphite crystal structures in a fiber direction of the graphitized fiber, and a continuous graphite crystal structure is attained in the longitudinal direction and the circumferential direction of the fiber, whereby the upper limit of the high elasticity of the graphitized fiber can be raised.

Figure 5:
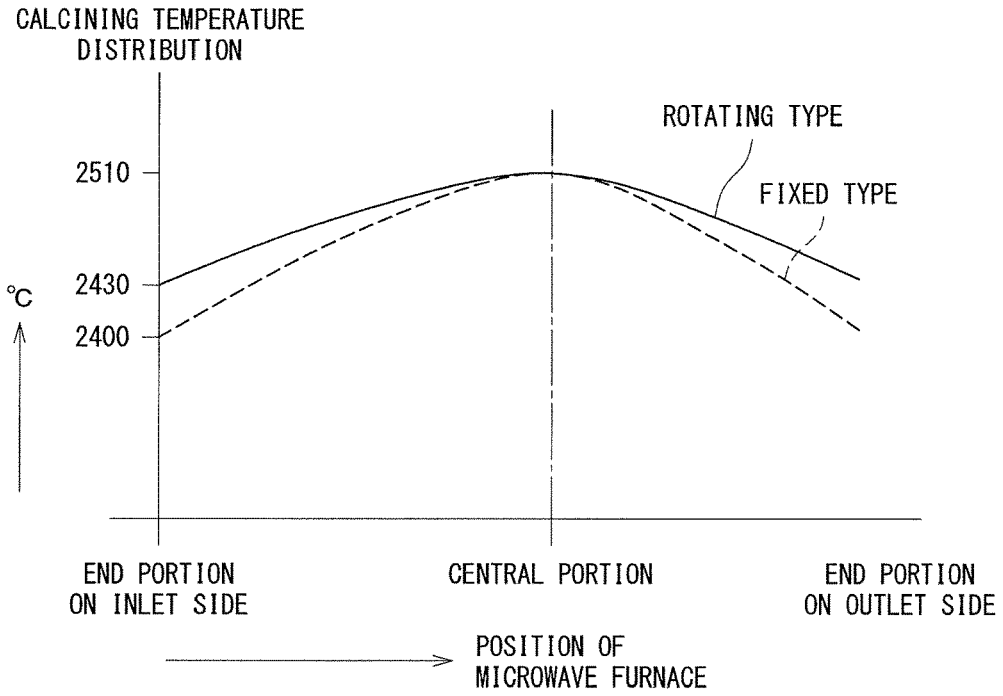
FIG. 5 is a temperature distribution curve obtained by measuring the temperature distribution in the furnace in an axial direction.

FIG. 5 is a temperature distribution curve obtained by measuring the temperature distribution in the furnace in an axial direction. The solid line shows the temperature distribution curve measured when the first tubular member 13 is rotated at 5 rpm and the broken line shows the temperature distribution curve measured when the first tubular member 13 is fixed. As is evident from this, it can be seen that there is less unevenness in the temperature distribution when the first tubular member 13 is rotated. Although the best temperature uniformity was achieved when the rotation number of the first tubular member 13 was 5 rpm, even with a rotational speed other than 5 rpm, as compared with the case of fixing the first tubular member 13, obvious superiority of thermal uniformity was recognized. Accordingly, unevenness in temperature distribution can be eliminated by rotating the first tubular member 13 at an arbitrary rotational speed of, for example, 1 to 50 rpm.

In Tables 1 and 2 below are shown test results of tests of tensile strength (Table 1) and elastic strength (Table 2) of calcined carbon fibers (Table 1) and graphitized fibers (Table 2) which were obtained by heating and calcining carbon fibers using the heating furnace 11 of the embodiment of the present invention. Samples Y1 to Y5 and samples Z1 to Z5 used in the tests of Table 1 and Table 2, respectively, are single fibers obtained by dividing the same thread size (800 Tex) of commercially available carbon fibers made of about 12,000 filaments. Therefore, the thread size of the single fiber is about 0.067 Tex=0.67 dTex=0.6 d (denier).

As is evident from the test results, in the case of the tensile strength (Table 1), when the first tubular member 13 having no hole or slit is used and the carbon fiber was calcined by only radiant heating in a state of not rotating the first tubular member 13, the tensile strength was up to 4,056 MPa, and when the first tubular member 13 having holes or slits is used and the carbon fiber was calcined by a combination of direct irradiation of the microwave and radiant heating in a state of rotating the first tubular member 13, the tensile strength was up to 4,622 MPa (increased by 14%).

Similarly, in the elastic strength (Table 2), when the first tubular member 13 was not rotated, the elastic strength was up to 428 GPa, and when the first tubular member 13 was rotated, the elastic strength was up to 498 GPa (increased by 16%). It is evident from this that it is effective for great improvements of tensile strength by carbonization and elastic strength by graphitization, respectively, to combine direct irradiation of a microwave and radiant heating and to rotate the first tubular member 13. Even with combination of radiant heating and rotation of the first tubular member 13 without direct irradiation of microwaves, tensile strength improvement of about 10% was found in each of samples Y1 to Y5 in Table 1. Also in each of the samples Z1 to Z5 in Table 2, an improvement in elastic strength of about 10% was found by combination of radiant heating and rotation of the first tubular member 13 without direct irradiation of microwaves.

TABLE 1

| Increase in Strength of Carbon Fiber by High-Temperature Calcination Tensile Strength (MPa) | | | |
|---|---|---|---|
| | | Calcined Carbon Fiber | |
| Sample No. | Carbon Fiber before Calcination (Single Fiber of 0.67 dTex) | First Tubular Member 13 not Rotated Only Radiant heating (1,500° C.) | First Tubular Member 13 Rotated Microwave Direct Irradiation + Radiant heating (1,500° C.) |
| Y1 | 3,480 | 3,960 | 4,611 |
| Y2 | | 3,760 | 4,562 |
| Y3 | | 4,112 | 4,780 |
| Y4 | | 3,860 | 4,380 |
| Y5 | | 4,056 | 4,622 |

It is found from Table 1 above that by heating and calcining the existing inexpensive low-strength carbon fiber with the microwave heating apparatus of the present embodiment, it is possible to grow the carbon crystal to increase the size, to improve the carbonization rate of a low-carbonized region existing within the fiber and to remove impurities within the fiber by calcination to increase the tensile strength.

TABLE 2

| Increase in Elasticity of Carbon Fiber by High-Temperature Calcination and Graphitization Elastic Strength (GPa) | | | |
|---|---|---|---|
| | | Calcined and Graphitized Fiber | |
| Sample No. | Carbon Fiber before Calcination (Single Fiber of 0.67 dTex) | First Tubular Member 13 not Rotated Only Radiant heating (2,500° C.) | First Tubular Member 13 Rotated Microwave Direct Irradiation + Radiant heating (2,500° C.) |
| Z1 | 223 | 402 | 466 |
| Z2 | | 375 | 452 |
| Z3 | | 428 | 498 |
| Z4 | | 404 | 459 |
| Z5 | | 411 | 468 |

Further, it is found from Table 2 above, by heating and calcining the existing inexpensive low-strength carbon fiber with the microwave heating apparatus of the present embodiment, carbon crystal can be grown and graphitized, and impurities within the fiber can be removed by calcination to increase the elastic strength.

Although the embodiments of the present invention have been described above, the present invention is not limited to the above-described embodiments and various variations may be made. For example, in the above embodiment, as shown in FIG. 1, two microwave irradiators 12 are arranged at the top and bottom, but the number and position of the microwave irradiators 12 can be appropriately increased and decreased or moved. Although the shapes of the first tubular member 13 and the second tubular members 14, 15 are both cylindrical, these tubular members are not necessarily cylindrical. In particular, since the second tubular member 14 or 15 does not rotate, it is also possible for the second tubular member 14 or 15 to have an arbitrary cross-sectional shape, for example, a rectangular cross section or the like.

REFERENCE SIGNS LIST

10: microwave heating apparatus
11: heating furnace
12: microwave irradiator
13: first tubular member
13*a*: through hole
14: second tubular member
14*a*: central hole
15: second tubular member
15*a*: large hole
15*b*: small hole
f: fiber member (single fiber thread of organic fiber or single fiber thread of carbon fiber)

The invention claimed is:

1. A microwave heating apparatus comprising:

a heating furnace in which a microwave irradiator is attached to a furnace main body having microwave permeability;

a running passage formed inside the heating furnace for passing a fiber member which is an object to be heated;

a first tubular member which is made of a first microwave heat-generating material for absorbing microwave energy and generating heat in the heating furnace, the first tubular member being rotatably disposed around the running passage; and a second tubular member which is made of a second microwave heat-generating material for absorbing microwave energy and generating heat in the first tubular member, the running passage being formed at a center portion of the second tubular member, wherein the fiber member is heated and calcined while running the fiber member in the running passage of the second tubular member, and wherein the first tubular member has formed therein through holes or through slits extending in a radial direction, the through holes or through slits allowing a microwave to pass therethrough to be directly irradiated to the fiber member in the running passage of the second tubular member.

2. The microwave heating apparatus according to claim 1, wherein the furnace main body having microwave permeability is made of ceramic, zirconia, alumina, quartz, sapphire, or a combined heat-resistant material of these materials.

3. The microwave heating apparatus according to claim 2, wherein the first microwave heat-generating material is made of a graphite material, a silicon carbide material, a silicidation metal, a silicidation ion compound, a silicidation graphite material, silicidation nitride, a silicidation carbon fiber composite material, a magnetic compound, a nitride, or a combined heat-resistant material of these materials.

4. The microwave heating apparatus according to claim 2, wherein the second microwave heat-generating material includes a graphite material, a silicon carbide material, or a mixed material of a graphite material and a silicon carbide material.

5. The microwave heating apparatus according to claim 2, wherein the fiber member is a single fiber of an organic fiber containing carbon or a single fiber of a carbon fiber, and is carbonized or graphitized by heating and calcinizing the single fiber.

6. The microwave heating apparatus according to claim 1, wherein the first microwave heat-generating material is made of a graphite material, a silicon carbide material, a silicidation metal, a silicidation ion compound, a silicidation graphite material, silicidation nitride, a silicidation carbon fiber composite material, a magnetic compound, a nitride, or a combined heat-resistant material of these materials.

7. The microwave heating apparatus according to claim 6, wherein the second microwave heat-generating material includes a graphite material, a silicon carbide material, or a mixed material of a graphite material and a silicon carbide material.

8. The microwave heating apparatus according to claim 6, wherein the fiber member is a single fiber of an organic fiber containing carbon or a single fiber of a carbon fiber, and is carbonized or graphitized by heating and calcinizing the single fiber.

9. The microwave heating apparatus according to claim 1, wherein the second microwave heat-generating material includes a graphite material, a silicon carbide material, or a mixed material of a graphite material and a silicon carbide material.

10. The microwave heating apparatus according to claim 1, wherein the fiber member is a single fiber of an organic fiber containing carbon or a single fiber of a carbon fiber, and is carbonized or graphitized by heating and calcinizing the single fiber.

* * * * *